United States Patent [19]

Sheikh et al.

[11] Patent Number: 5,012,767

[45] Date of Patent: May 7, 1991

[54] HEAT EXCHANGER TUBE SPACERS

[75] Inventors: Ramsey U. Sheikh, Oley; Steve A. Stavrou, Gilbertsville, both of Pa.

[73] Assignee: Leighton Industries, Inc., Phoenixville, Pa.

[21] Appl. No.: 416,352

[22] Filed: Oct. 3, 1989

[51] Int. Cl.[5] ..... F22B 37/06

[52] U.S. Cl. ..... 122/511; 122/235.14; 165/162

[58] Field of Search ..... 122/235 A, 235 C, 511, 122/512; 165/162

[56] References Cited

U.S. PATENT DOCUMENTS

| | | | |
|---|---|---|---|
| 523,672 | 7/1894 | Long | 122/235 A |
| 2,477,950 | 8/1949 | Bailey | 257/248 |
| 2,757,649 | 8/1956 | Coughlin | 122/478 |
| 3,760,592 | 9/1973 | Neelen | 122/510 |
| 3,838,665 | 10/1974 | Astrom | 122/235 A |
| 3,844,254 | 10/1974 | Astrom | 122/235 A |
| 4,041,907 | 8/1977 | Chayes | 122/510 |
| 4,245,694 | 1/1981 | Smith | 165/82 |
| 4,285,396 | 8/1981 | Schwoerer et al. | 122/511 |
| 4,307,777 | 12/1981 | Chwyla | 165/76 |
| 4,412,510 | 11/1983 | Perry et al. | 122/510 |
| 4,423,703 | 1/1984 | Esselman et al. | 122/512 |
| 4,550,690 | 11/1985 | Baugher | 122/511 |
| 4,607,690 | 8/1986 | Seshamani | 165/162 |
| 4,756,278 | 7/1988 | Fournier | 122/235 A |
| 4,796,690 | 1/1989 | Elsinger | 165/67 |
| 4,848,452 | 7/1989 | McDonald et al. | 122/511 |

OTHER PUBLICATIONS

Edison Electric Institute, "Superheater Supports", Nov. 1964, publ. No. 64-66.

*Primary Examiner*—Edward G. Favors
*Assistant Examiner*—Denise L. F. Gromada
*Attorney, Agent, or Firm*—Charles H. Lindrooth

[57] ABSTRACT

Pendant superheater or reheater tubes are maintained in spaced relationship by pairs of collar elements joined together in a closely adjacent relationship. One of the collar elements is dimensioned allow for vertical movement of the tube over which it is fitted throughout the range of temperatures to which the tubes are exposed. The other collar is mechanically fixed to the adjacent tube without welding or other means of physically joining in a manner which prevents vertical or rotational movement. The paired collars are physically joined as by welding so that the fixed collar fixes the spacing between tubes and maintains them in the same horizontal plane while allowing for relative vertical movement. As illustrated the fixed collar is locked by being mounted on a curved tube section having a curvature sufficient to prevent relative vertical movement and through interference with the collar wall to prevent relative rotational motion.

5 Claims, 2 Drawing Sheets

FIG. 2
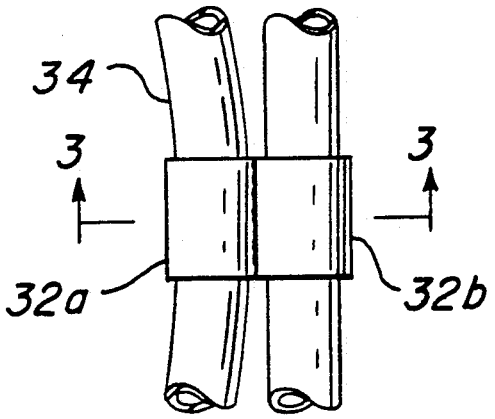
FIG. 3a
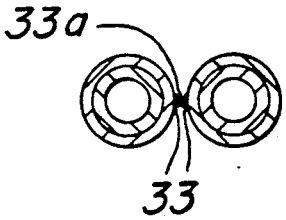
FIG. 3
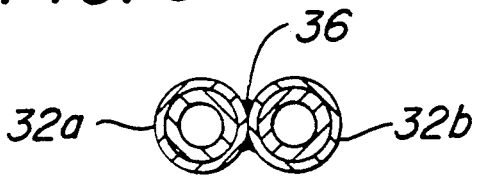
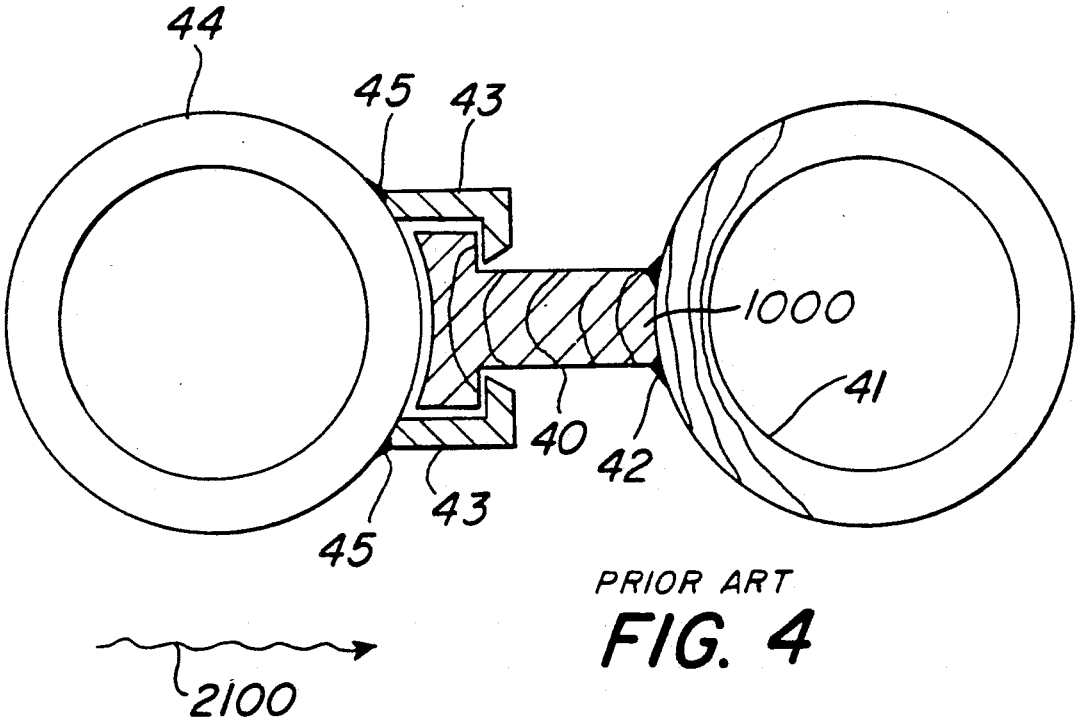
PRIOR ART
FIG. 4

HEAT EXCHANGER TUBE SPACERS

FIELD OF THE INVENTION

This invention relates to the spacing of vapor-containing tubes in heat exchange relationship with a high temperature gas and more especially to means for maintaining vertically extending runs of such tubes in fixed, side-by-side relationship.

BACKGROUND OF THE INVENTION

In pendant superheater and reheater units of the convection type, wherein tubes containing saturated vapor at high pressure are heated to impart additional energy thereto, it is known that temperature differentials in the stream of hot gases are a potentially significant cause of premature tube falure. Such failures occur on account of the differential expansion of the tube metal from tube-to-tube within a unit. The temperature differences will cause the tubes to shift out of their original positions producing stresses, and metal fatigue and tube misalignment. The later effect leads to a still further increase in stress as well as erosion and ash build up when the tubes shift out of alignment into the path of hot gases.

In heater designs of the type referred to the tubes are formed in a series of vertically extending straight runs extending parallel to each other. Various spacers of ties have been employed in the past in order to maintain the horizontal spacing between adjacent straight runs. Because of temperature differences from tube to tube, such spacers or ties must allow for differential lengthwise expansion of the adjacent runs. Failure to make allowance for differential vertical expansion by using a spacer or tie which is either welded or otherwise physically joined to the tubes, will set up stresses in the spacer and in the tubular wall material which will eventually lead to failure at the point where one is joined to the other. A failure at this point is likely to result in a rupture of the pressurized tube requiring a shutdown of the entire system.

In an effort to allow for differential vertical expansion of vertically extending heat exchange tubes, spacers such as are shown in U.S. Pat. Nos. 2,477,950, 2,757,649 and 4,412,510 have been provided. These spacers or ties have in common pairs of interengaging elements each of which is welded to one of a pair of adjacent tube walls. Although the elements interengage one another to prevent relative movement in the direction of gas flow, they do allow for lengthwise relative movement of the vapor filled tubes thereby reducing to a degree the cause of failure mentioned above. Despite the fact that these spacers eliminate failure caused by relative differential expansion when the tubes vertically expand in relation to one another, failures persist. A careful analysis will show that this is because there is a temperature differential existing from the inside of a tube, extending through the tube wall and through the physically connected spacer element to the point where it contacts the second spacer element. This differential eventually causes metal fatigue at the point of attachment between the spacer element and the tube wall which weakens the wall and may cause failure of the tube at that point. The condition is exaggerated when the spacer is constructed from a metal different from the tubes. The above referenced U.S. Pat. No. 4,412,510 offers a partial solution to the problem in that adjacent tubes are maintained in tangential relationship thereby minimizing tube to tube temperature differentials. Nevertheless, it has been found that the temperature gradient through the welded tie means and tube wall remains a significant source of failure at the weld.

SUMMARY AND OBJECTS OF THE INVENTION

The present invention involves the provision of spacer or tie means allowing for relative vertical expansion of pendant heat exchange tubes by providing interconnected spacer sleeve or collar elements which are integrally connected or physically joined as by welding. An important feature of the invention is that the spaces elements are mechanically connected to the tubes, that is to say they are not physically joined to the tubes as by welding. According to the invention, each of the collar or sleeve elements is fitted over one of a pair of adjacent tubes. The internal diameter of one of the collar elements is sized to allow for sufficient clearance with the tube on which it is fitted so that relative vertical movement is always permitted over the range of operating temperatures. The second collar element is not physically joined to but is mechanically restrained against relative movement either lengthwise or rotationally with respect to the tube over which it fits. Preferably, the mechanical restraining means comprises sinuous or serpentine curved sections included within the straight tubular sections which extend close to an adjacent vertical tube. By mounting the physically interconnected collars on the tubes at the point they are most closely adjacent, the collars are both locked against vertical movement. In addition, the wall of the curved section is in an interfering relationship with the collar mounted on it so as to effectively lock the spacer against any rotational movement.

The use of the invention achieves the object of the elimination of welding or otherwise physically joining of a spacer device to the wall of a pressure vessel operating in a high temperature environment. Other objectives achieved by the invention are the substantial reduction in tube failure and the consequent need for emergency boiler shutdown of high temperature pendant reheaters and superheaters. A still further object is the provision of tube spacer or tie means for vertically extending tubular runs of heat exchanger tubes exposed to high temperature, characterized by relative ease of fabrication, assembly and replacement.

Other objects, advantages and features of the invention will become readily apparent from the following detailed description and from the accompanying drawings.

BRIEF DESCRIPTION OF THE DRAWINGS

In the drawings:

FIG. 2 is an enlarged detail view, showing a spacer device used in carrying out the present invention;

FIG. 3 is a sectional view of the spacer device of FIG. 2;

FIG. 3*a* is a sectional view of an alternative form of spacer device; and

FIG. 4 is a sectional view through a prior art spacer device.

DETAILED DESCRIPTION

Figure 1:
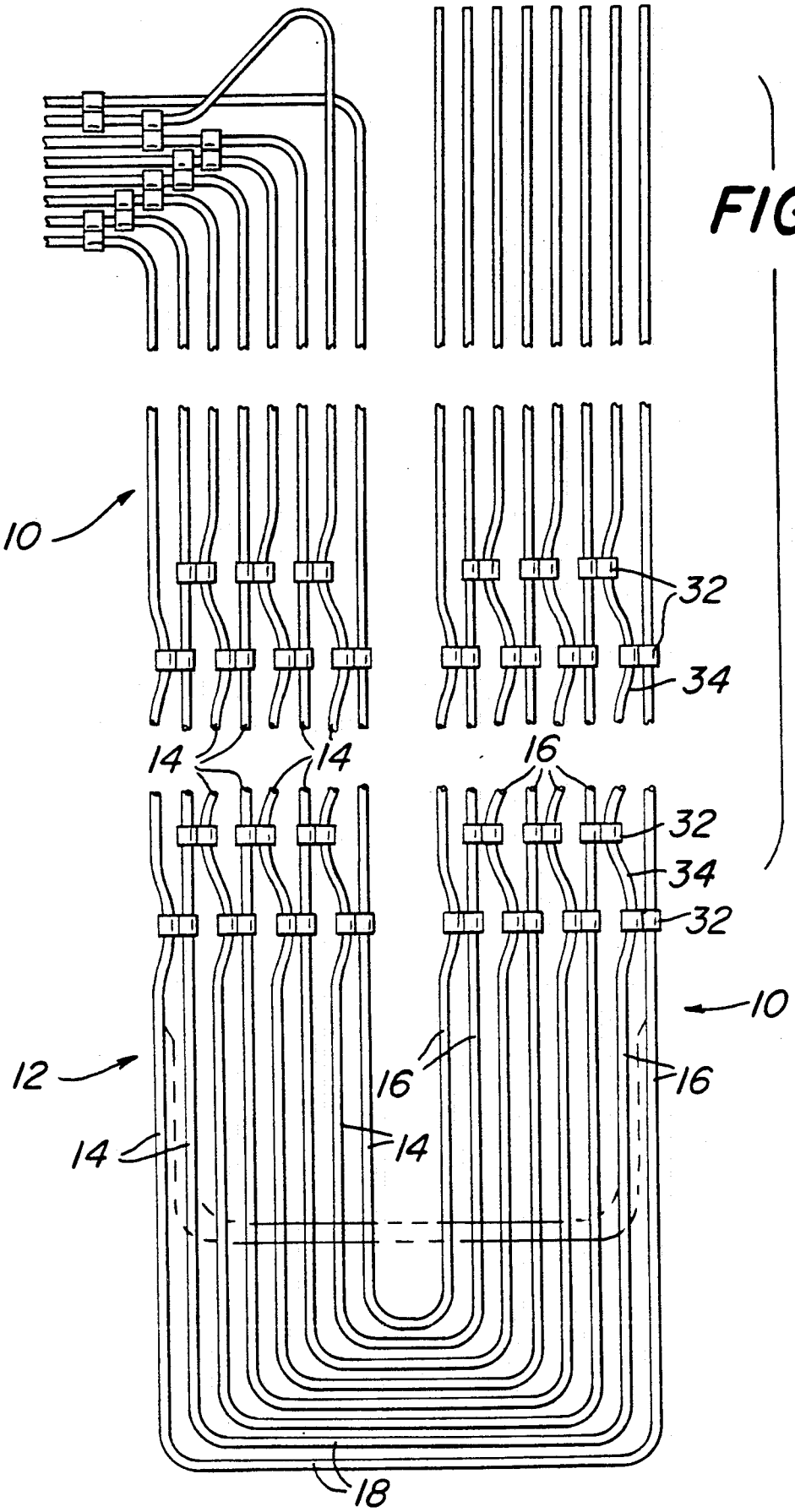
FIG. 1 is a schematic view of of pendant type superheater incorporating spacer means formed according to the principles of the present invention.

Referring now to the drawings which are illustrative of the preferred embodiment of the invention, and more particularly to FIG. 1, a portion of a pendant type superheater is identified generally by the reference character 10. As will be recognized by those of ordinary skill in the art, the unit comprises a multiplicity of vertically extending tubes 12, which receive saturated steam from a boiler not shown. In the illustrative embodiment each tube comprises a first vertical run 14 having an inlet at its upper end and a second vertical run 16 interconnected to the first run by a transversely extending tubular section 18. The tubes are exposed to high temperature flue gases which are passed transversely of and in heat exchange relationship with the runs 14 and 16 at temperatures which typically are on the order of 2100° F. Superheated steam is delivered from the second run 16 through a header to a turbine or other steam powered device.

In superheater and reheater units of the type referred to, the tubes 12 are suspended solely from supports at their upper ends, thus allowing freedom for axial expansion of all tubes of a unit. An arrangement of tie or spacer means 32 formed according to the invention maintain the tubes 12 in the same vertical place and in fixed spaced apart relationship in a manner which allows for relative vertical expansion of each tube relative to the others within a bank or group of tubes.

Turning now to a more detailed description of the nature and construction of the tie means, it will be noted that at each point where it is desired that a vertical run is to be tied to the next adjacent vertical run a sinuous or serpentine curved tube section 34 is provided in one of the runs in order to provide an attachment point where minimum spacing exists between the two runs.

Although the sections 34 are represented by interconnected straight lines in FIG. 1, at least the portions adjacent the adjacent straight runs are curved as depicted in FIG. 2.

Although the tie means may assume other forms, it conveniently comprises paired stainless steel rings or collars 32*a* and 32*b* which are preferably substantially in tangential relationship and integrally or otherwise physically joined to one another as by welding as shown at 36 in FIG. 3. Each of the paired collars has an internal diameter which is sufficiently large with respect to the tube section over which it fits so that it may be slidably fitted over the tube section. However, once the rings are installed, the serpentine curved tube section 34 serves as a restrainer means which restricts vertical and rotational movement of collar 32*a* whereas the collar 32*b* allows for unrestrained relative movement of the straight tube section over which it fits. A few thousandths of an inch clearance in spacer collars of about $1\frac{1}{2}$ to $2\frac{1}{2}$ inches in diameter will produce satisfactory results.

In accordance with a preferred embodiment of the invention, the collars 32*a* and 32*b* are formed of stainless steel to avoid overheating and burnoff whereas the tubes are conventionally formed of carbon steel, chrome alloy, or stainless steel. Even at the higher end of the range of temperatures to which the tubes may be exposed there should be sufficient clearance between a collar surrounding a vertically extending tube so as to allow for vertical expansion and relative movement of the tube relative to its collar.

An alternative form of spacer means is illustrated in FIG. 3 wherein the wall of adjacent collars is pinched or otherwise worked to form beads 33 which are joined by welds 33*a*. Preferably the beads project from the sleeve side walls by no more than about $\frac{1}{8}''$ thereby maintaining a spacing between sleeves of no more than above $\frac{1}{4}''$.

In comparison with the tie means of the present invention, FIG. 4 illustrates a pair of tubes interconnected by tie means formed in accordance with the teachings of the prior art. In the arrangement of FIG. 4, a first T-shaped tie member 40 is connected to a first tube 41 by means of a weld 42. T-shaped tie member 40 fits within a pair of L-shaped guide members 43 which are in turn secured to tube 44 by welds 45.

In the presence of hot gases having a temperature on the order of 2100° F. or greater, relatively cool vapor within the tube 41 having a temperature on the order of 1000° F., and tube wall temperatures of about 1150° to 1200° F., it can be seen that there will be a temperature gradient extending from the inside of the tube 41, across the tube wall through the weld 42 and through the T-shaped member 40. Even though the tie means of FIG. 4 allows for relative vertical expansion of the tubes 41 and 44, the temperature gradient aforementioned acts to set up stresses in the wall tube 41 at the point where the T-shaped member is welded to the wall. Over a period of time, due to repeated and prolonged stressing, the wall becomes subject to failure at the point of welding particularly when the tie element and the tube are of different metals. Because the tube is a pressure vessel, failure of the tube wall requires shutdown of the entire system.

In contrast, with applicant's spacer means neither retainer collar is welded or otherwise physically joined to the tube it retains. Relative differential vertical expansion is always permitted. In addition, the tie means prevents shifting of the tubes out of the vertical plane in which they are originally positioned, thereby avoiding any disruption in the gas flow. This avoids obstruction of the flow of hot gases, ash build up and erosion and further increases in the temperature differentials between adjacent tubes. With either form of spacer of the invention, should a failure should occur it occurs at the point where the two collars are joined together rather than at the joint between one of the collars and the pressurized tube it retains. Maintaining the collars in substantial tangential relationship serves the further purpose of reducing the risk of overheating and burnup of the spacer. Maintaining the collars no more than about $\frac{1}{4}$ inch apart is sufficient to avoid burnup and allows room for a cutting tool to separate the collars should replacement become necessary.

In use, the collars may be separately fitted onto the tubes, moved to the desired locations on adjacent tubes and then joined together.

I claim:

1. In a vapor heating unit comprising convection heater means and a bank of spaced apart upright vapor tubes extending transversely of the flow path of heating gases generated by said heater means, spacer means for maintaining a constant distance between said tubes and for allowing axial movement of a first of said tubes relative to a second tube adjacent to the first, said spacer means including a first ring shaped collar element surrounding a first one of said tubes, means comprising said first ring shaped collar element for receiving said first one of said tubes, said first ring shaped collar element means providing clearance with said tube for relative axial movement, and said spacer means further including a second ring shaped collar element joined to the first ring shaped collar element in side-by-side relationship therewith, said second ring shaped collar element surrounding said second tube and mechanical restraining means for preventing relative axial and rotational movement of the second ring shaped collar element with respect to the second tube.

2. In a vapor heating unit according to claim 1 wherein said mechanical restraining means comprises a serpentine bend section in said first one of said two adjacent upright tubes, said bend section being curved toward the periphery of the second of the said two tubes and wherein said second ring shaped element is mounted at the midpoint of the curve of said serpentine bend section, the curvature of the bend of said bend section being sufficient to retain the ring shaped spacer means in fixed relationship with the said second tube.

3. In a vapor heating unit comprising first and second side-by-side substantially vertically extending straight tube sections, wherein said tube sections contain a vapor under pressure above atmospheric, and heater means for generating a flow of heating gas transversely and in heat exchange relationship with said tube sections, spacer means for maintaining a constant fixed distance between the tube sections comprising first and second physically interconnected collar elements sized to fit on said tube sections in surrounding relationship therewith, the centerline distance between the collar elements being less than the centerline distance between said tube sections, means comprising the first one of said collar elements for restraining a first of said tube sections from lateral movement, said first one of said collar elements further comprising clearance means to allow for relative lengthwise movement of said first tube section, the second said tube section including a serpentine curved portion which curves in a direction toward the said first tube section to a point where the centerline distance to the said first tube section is equal to the centerline distance between adjacent collar elements and then returns to said fixed distance, the second of said paired collar elements surrounding the said second tube section at the said point, the curved portion comprising means to restrict axial and rotational movement of the second of said paired collar elements relative to said second tube section in the absence of any physical connection with the second tube section, the paired collar elements being free of other means securing either collar element to either tube section.

4. In a heat exchange means comprising a plurality of side-by-side vertically extending pendant tube sections wherein said tube sections contain steam at high pressure, and heater means for generating a flow of heating gas transversely of the tube sections and in heat exchange relationship therewith, spacer means for maintaining a constant distance between adjacent tube sections comprising paired retainer collars surrounding adjacent tube sections, one of said collars surrounding a straight run of one of said adjacent tube sections said one collar comprising clearance means relatively dimensioned with respect to said one tube section to allow for relative axial movement of said one tube section at least at the upper end of the range of temperature of said heating gas and means for the prevention of movement of the spacer means in relation to the other of said adjacent tube sections throughout the range of temperatures of said heating gas without any physical connection between the spacer means and said other tube section.

5. In a heat exchange means according to claim 4 wherein said adjacent tube sections are spaced a constant fixed distance and wherein said means for prevention of movement of the spacer means comprises an intermediate serpentine curved section having a portion closer to the other of said adjacent tube sections than said constant fixed distance, the other of said collar being mounted on said portion of said serpentine curved section in surrounding relationship therewith.

* * * * *